US008863560B2

(12) United States Patent
Pedersen

(10) Patent No.: US 8,863,560 B2
(45) Date of Patent: Oct. 21, 2014

(54) TUBULAR PELT BOARD INNER BAG

(75) Inventor: Henrik Palsgaard Pedersen, Brovst (DK)

(73) Assignee: Dansk Mink Papir A/S, Holstebro (DK)

( * ) Notice: Subject to any disclaimer, the term of this patent is extended or adjusted under 35 U.S.C. 154(b) by 0 days.

(21) Appl. No.: 13/704,567

(22) PCT Filed: Jun. 16, 2011

(86) PCT No.: PCT/DK2011/050219

§ 371 (c)(1),
(2), (4) Date: Mar. 1, 2013

(87) PCT Pub. No.: WO2011/157277

PCT Pub. Date: Dec. 22, 2011

(65) Prior Publication Data

US 2013/0152642 A1 Jun. 20, 2013

(30) Foreign Application Priority Data

Jun. 16, 2010 (DK) ..... 2010 00527

(51) Int. Cl.
*C14B 1/26* (2006.01)
*C14B 15/06* (2006.01)
*C14B 1/58* (2006.01)

(52) U.S. Cl.
CPC . *C14B 1/26* (2013.01); *C14B 15/06* (2013.01); *C14B 1/58* (2013.01)
USPC ..... 69/19.2

(58) Field of Classification Search
CPC ..... C14B 1/26; C14B 1/58; C14B 15/06
USPC ..... 69/19.1, 19.2, 22; 383/102, 127; D22/199
See application file for complete search history.

(56) References Cited

U.S. PATENT DOCUMENTS 6,391,357 B1 * 5/2002 Muise et al. ..... 426/407
6,701,756 B2 * 3/2004 Hedegaard ..... 69/22
(Continued)

FOREIGN PATENT DOCUMENTS

| | | |
|---|---|---|
| DK | 9600208 | 7/1996 |
| DK | 176485 | 5/2008 |
| DK | 176354 | 7/2009 |

OTHER PUBLICATIONS

International Search Report on related PCT application (PCT/DK2011/050219); International Searching Authority (Nordic Patent Institute) dated Aug. 30, 2011.

*Primary Examiner* — Shaun R Hurley
(74) *Attorney, Agent, or Firm* — Klein, O'Neill & Singh, LLP

(57) ABSTRACT

Using modern pelt boards (2) with surface (10) with open structure (12) in connection with drying out pelts (36), where the pelt is retained in stretched position during the drying procedure with a holding bag (44), which in an area near the tail part of the pelt is pressing the pelt against a special holding area (4) n the surface of the pelt board, there may occur areas of the pelt where it can't be retained sufficient during the drying procedure, to maintain the stretched size, and further the occurs areas where the pelt is not dried out sufficient and thus becomes moldy or rot. To solve this problem there is indicated a tubular pelt board inner bag (2) of perforated, fat- and moisture absorbing material which is peculiar in, that the pelt board inner bag (6) at least nearest to the first end boundary (26) and/or the second end boundary (24) comprises a number of removals in the bag material in shape of holes (30, 34), and/or rows of holes (28, 32), where the holes (30, 34) has a larger diameter than the perforations. The rows of holes ensures an improved retaining of the pelt in the stretched out position, and further a better drying out of the pelt in the areas where the rows of holes occurs.

5 Claims, 5 Drawing Sheets

(56) References Cited

U.S. PATENT DOCUMENTS 7,578,153 B2 * 8/2009 Hedegaard ..... 69/19.1
7,617,657 B2 * 11/2009 Liu ..... 53/469
2003/0019255 A1 * 1/2003 Hedegaard ..... 69/22
2008/0101732 A1 * 5/2008 Liu ..... 383/102
2008/0245116 A1 * 10/2008 Hedegaard ..... 69/19.1

* cited by examiner

TUBULAR PELT BOARD INNER BAG

CROSS-REFERENCE TO RELATED APPLICATION

This application is a national phase filing, under 35 U.S.C. §371(c), of International Application No. PCT/DK2011/050219, filed Jun. 16, 2011, the discloser of which is incorporation herein by reference in its entirety.

FEDERALLY SPONSORED RESEARCH OR DEVELOPMENT

Not Applicable

BACKGROUND

The present invention relates to a tube shaped pelt board inner bag of fat- and moisture absorbent material with a first end boundary and a second end boundary, of the kind used for cladding of pelt boards used in drying the leather side of pelts, said pelt boards comprising a nose end and a foot end and a holding area where the pelt in stretched position is retained in stretched position during the drying procedure, where the pelt comprises a jaw part and a rear edge of the back side of the pelt, and where the pelt board inner bag consists of a tube shaped bag item the wall of which is perforated.

The use of an fat absorbent cladding of pelt boards used for drying out pelts from fur animals is well known. The fat absorbing cladding, which often consists of paper, serves for protection of the pelt board, which often consists of wooden pelt boards. Earlier was paper from newspaper used for wrapping the pelt boards, before they were provided with pelts to be dried out. However, the newspaper were difficult to remove subsequent to the drying out of the pelts, and thus there were later developed tube shaped bags of paper, suited for tearing on the outside of the pelt board, as it appears from DK 96 00208 U3. From said utility model registration it is further known to perforate the paper material the bags are made of, with the intent to improve the air flow during the drying procedure. The perforations are made by pricking needles through the paper material whereby there is provided a large number of tiny openings in the paper surface which allows air flow through the wall of the bag.

Mounting the pelts to be dried out on the pelt boards, a stretching out of the pelt is performed with the intend to achieve a nicely pelt, the size of which after the end of the drying procedure is very crucial for the achievable sales price for the pelt. Thus to maintain the pelt in its stretched out position, there were and are still used 8-15 stables driven through the lower end of the pelt and into the wooden pelt board, whereby the pelt chiefly maintains the length to which it has been stretched out to, subsequent to the finish of the drying procedure. However, said stables leaves holes in the pelt, reducing its value. To prevent this, there is developed a method for non destructive tanning of pelts, as it appears from DK 174 865 B1, comprising a holding bag, which is drawn onto the pelt board with the pelt board inner bag and the pelt, so that the bag is pressed against the fur side of the pelt whereby there is achieved sufficient friction, to reduce the number of stables to 2 or none, whereby the pelt is not damaged significantly (few holes compared to earlier), alternatively, if minor size categories of the pelt is acceptable, that the pelt does not have holes at all.

However, the size category for a pelt used in fur production very crucial for the achievable prize on the pelt auction, for a fur farmer. Only a single size category can mean huge amounts in earnings for a fur farmer, therefore there has been made further developments in the technique concerning drying of pelts with the intent to achieve larger size categories for the dried pelts, as well as the fact that said pelts have holes remained from retaining means for fastening the pelt in stretched position on the pelt board during the drying procedure. The problem in using the known wooden pelt boards of a flattish conical rod/board in combination with a holding bag as disclosed in DK 174 865 B1 is, that the holding bag mainly provides friction for retaining the pelt in the areas around the short sides of the board, ie. the pressure force from the holding bag on the broad side of the pelt board is insignificant, whereby the pelt around the tail, and the back side of the pelt might creep during the drying procedure, therefore is said two stables used to fasten the pelt in these areas.

SUMMARY

To overcome said problems there is developed a pelt board comprising a velvet structure both in the longitudinal direction and in the height direction, which typically consists of two interrelated velvet half shells of plastic with an open/perforated structure, the periphery of which along their sides defines a cavity in which the air is exchanged during the drying procedure.

Another developed pelt board consists of a body with protruding longitudinal ribs, the height of which is largest at the center of the pelt board, and the height of which decreases out against the side boundary of the pelt board, whereby the ridges of the ribs in combination with the tube shaped pelt board inner bag and a pelt drawn onto the pelt board defines a cavity with an elliptical section at least in the holding area of the pelt board.

Common for both pelt boards is that said cavity via an opening in the foot end of the pelt board is connected with a not here specified device for exchanging of the air inside the pelt board via the open structure by natural openings in the pelt during the drying procedure.

The pelt board comprising said half shells comprises a holding area, where the surfaces on the side facing the leather side of the pelt comprises a corrugation/serration/toothing or other roughness, mainly oriented across the longitudinal direction of the pelt board, whereby the pressure force from the holding bag is made more efficient, due to a larger friction which is provided as the leather side of the pelt is pressed against the corrugation/serration/toothing or other roughness in the holding area. Between the half shells is further located a distension element which by axially displacement in the longitudinal direction of the pelt board respectively against the nose end and the foot end of the pelt board will lead to that the half shells will be displaced away from each other and against each other. The displacement of the half shells against each other provides for an easier removal of the pelt when the drying procedure is terminated, as the pelt shrimps during the drying procedure and thus will tight around the surface of the pelt board, and thus a displacement of the half shells towards each other will lead to a significant decrease of the friction force between the pelt board surface/the pelt board inner bag and the leather side of the pelt, thanks to the reduction of the circumference of the pelt board displacing the half shells towards each other.

The pelt board which consists of an elongated body with protruding longitudinal ribs does not provide the possibility for reducing the circumference of the pelt board why the removal of the pelt from the pelt board will be more difficult to implement, than removal of the pelt from the pelt board with the mutually displaceable half shells, cf. the above, and likely therefore it is not possible to establish an appreciable corrugation, as the pelt will be stocked in it, and the removal of the pelt will thus be very difficult to perform without large risk of damaging the pelt. The lack of corrugation in the holding area leads also to the need of a considerable larger pressure force than the pressure force which can be achieved by the known holding bag. Therefore a tight wrapping of the holding area with plastic wrap is used instead, which leads to the need of a pelt board inner bag, cf. below.

This has lead to that the pelts are sought to be stretched to even larger pelt size categories, whereby the problem concerning the retaining og the back skin around the tail again has become crucial. Moreover, practical tests with the holding bag in combination with the new developed pelt board shown, that the strong pressure on the leather side of the pelt against the holding areas leads to that the areas of the leather side of the pelt which is pressed against the pelt board during the drying procedure are not dried out sufficiently, thereby creating a kind of decay of the pelt, which becomes black, and further a condensation and fluid extract on the fur side of the pelt, which is obviously undesirable. In particular in connection with pelts which is thick in the leather, and poorly scratched pelts, this problem has been pronounced. To solve this problem considerations concerning using the familiar cover bag, which extends essentially over the whole length of the pelt board, but that would be quite superfluous since the structure of new developed pelt board allows a much more efficient/swift drying out of the pelts than it earlier was possible using pelt board bags on wooden pelt boards, whereby the use of said pelt board bags probably would solve the problem, but would lead to an unwanted extension of the drying time for the pelts. Further will the presence of a pelt board bag be an obstacle for optimal air flow and accordingly drying out of the areas of the of the pelts, where these has 3 layers Thus there has been developed a holding bag for solving said problem in shape of a pelt board bag of the kind stated in the preamble, as disclosed in DK 176 354 B2, where the pelt board bag consists of a tube shaped bag item for drawing onto the outside of the pelt board from its tip end, for covering at least a part of the holding area on the pelt board, the extension of said pelt board bag at least corresponding to ⅓ but preferably half of the extent of the holding area on the pelt board. There is hereby achieved a larger friction force between the leather side of the pelt and the holding area on the pelt board, which leads to the achievement of a straight measure line at the lower end of the pelt around the tail after the termination of the drying procedure, and at the same time, that the fluid accumulated in the leather side of the pelt in the holding area, more specific where the pelt is pressed against the surface of the pelt board can be removed by the capillary effect of the fat- and moisture absorbing material exchanging the air in the cavity defined of the half shells. The moisture is drawn out into the fat/moisture absorbing material below which said exchange of air is performed, whereby the above decomposition of the pelt which thereby will become black, and fluid extract on the fur side of the pelt is effectively counteracted.

Among the further advantages using the pelt board bag according to DK 176 354 B2 is that it further absorbs residual fat on the leather side of the pelt in the holding area, which leads to that this area of the distension/pelt board is not "greased" as it else would, with accordingly reduction of the friction forces, as this area of the pelt board is not greasy which makes the pelt board easier to handle.

It appears, however, despite the improved effect by the bag disclosed in DK 176 354 B2, that it will be necessary to improve said pelt board inner bag since the practically use has shown, that the lower end of the pelt at the tail has moved during the drying procedure, with achievement of smaller pelts than expected. Thus there is need for creating an improved friction between the pelt board inner bag and the surface of the pelt board so that the pelt stretched out on the pelt board is better retained in its stretched position by a holding bag, drawn onto the fur side of the pelt.

An additional problem with the otherwise well functioning pelt board inner bag disclosed in DK 176 354 B2 is that it does not have a sufficient length to reach the area of the pelt board where the front paws of the pelt is located where the pelt on certain locations is triple belt and where the scraping of the pelt often seems to be deficient, why the presence of a fat absorbing material is desirable, but where a high degree of exchange of the air in the cavity below the pelt/pelt board inner bag is preferred.

It is by the invention realized that first mentioned problem can be solved by a tubular pelt board inner bag of the kind stated in the preamble, which is characterized in, that the pelt board inner bag at least closest to the first end boundary and/or the second end boundary comprises a number of removals in the bag material in shape of holes and/or rows of holes, where the holes has a larger diameter than the perforations.

It is hereby ensured that the bag achieves a better grip in the corrugations in the holding area of the pelt board in the holding area of the pelt board as the holding bag presses the area with hole rows against the corrugations, so that a portion of the holes is pressed down to complete or partly in engagement with the corrugated/coarse structure of the holding area, and thereby the pelt is better retained in the stretched position during the drying procedure.

A further advantage by the hole rows is that a more direct connection between the cavity defined between the pelt board and the pelt/the pelt board bag, which will reduce the drying time, together with the achievement of the above advantages combined with the use of the pelt bag according to DK 176 354 B2.

I case that the length of tubular pelt board inner bag is adapted in a manner that it reaches up to the area where the front paws of the pelt are located, the hole rows in this area will lead to an improved drying out of the leather side of the pelt, thanks to increased admittance for the drying air together with that the fat absorbing properties of the pelt board inner bag is utilized to the removal of the residual fat in the area around the front paws In this context it should be emphasized, that when there is mentioned perforations, there is meant holes with a very narrow diameter compared to the holes in the hole rows in the pelt board inner bag.

With the intent to manufacture the pelt board bag according to the invention at a competitive price, the fat- and moisture absorbing material may consist of paper.

Without renouncing other methods to establish the removals in the bag material in shape of holes and/or hole rows these might be established by punching and/or boring and/or water cutting and/or laser cutting and/or burnout.

With the intent to achieve an efficient removal of fat and moisture from the leather side of the pelt, the pelt board bag may have a conical shape corresponding to the shape of the pelt board, so that it can be arranged in attach with relevant parts of the holding area of the pelt board drawing it over the pointed end of the pelt board against the foot end. Hereby is achieved that the pelt board bag according to the invention remains on its location in the holding area during the stretching out of the pelt.

In another embodiment the tube shaped pelt board inner bag may have parallel sides and correspond to the shape og the pelt board, so that it can be arranged in engagement with the holding area of the pelt board drawing it from the nose end against the foot end of the pelt board.

This embodiment is suited for pelt boards for larger fur animals, such as foxes.

In a further embodiment where the tube shaped pelt board inner bag solely shall serve as improvement of the retaining of the stretched out pelt in the holding area of the pelt board, it may have an extent corresponding to at least ⅓, but preferably half of the extent of the holding area of the pelt board.

In an embodiment where the tube shaped pelt board inner bag further shall serve as fat absorbent layer at the area of the front paws of the pelt, it may further advantageously have a length which at least corresponds with the length of the stretched out pelt on the pelt board measured between the against the foot end og the pelt board facing end of the jaw part of the pelt, and the lower edge of the back of the pelt, and in a further embodiment, said tube shaped pelt board inner bag may have a length corresponding with the length of the stretched out pelt on the pelt board measured between the against the foot end og the pelt board facing end of the jaw part of the pelt, to a point below the lower edge of the back of the pelt.

BRIEF DESCRIPTION OF THE DRAWINGS

The invention is described more detailed in the following referring to the drawing, where.

DETAILED DESCRIPTION

Figure 1:
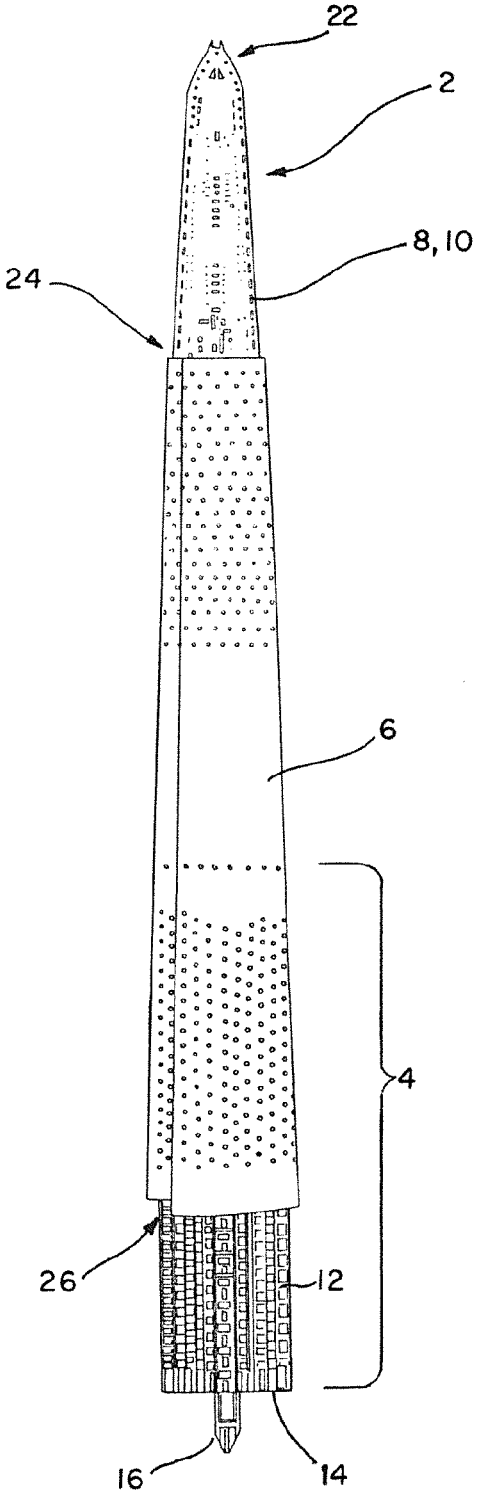
FIG. 1 is a side view of a modern pelt board with a drawn on tube shaped pelt board inner bag, where the holding area of the pelt board is partly covered with a pelt board bag according to the invention.

In FIG. 1 is shown a modern pelt board 2, comprising a holding area 4 which is partly covered with a tube shaped pelt board inner bag 6 according to the invention. The modern pelt board 2 consists in the shown embodiment of two assembled arched half shells 8, the surfaces 10 of which has a very open structure in shape of holes 12. The half shells 8 delimits together a cavity which is open at the foot end 14 of the pelt board 2, where it comprises a from the foot end 14 blunt protruding party 16, which is connected with a displaceable distention element 18 (cf. FIG. 6), which is displaceable between a retracted position where the half shells 8 is in engagement with each other along the side edges 20, and a pushed forward position wherein it is located between the side edges 20 of the half shells 8. The pelt board 2 comprises further a pointed nose end 22.

Figure 2:
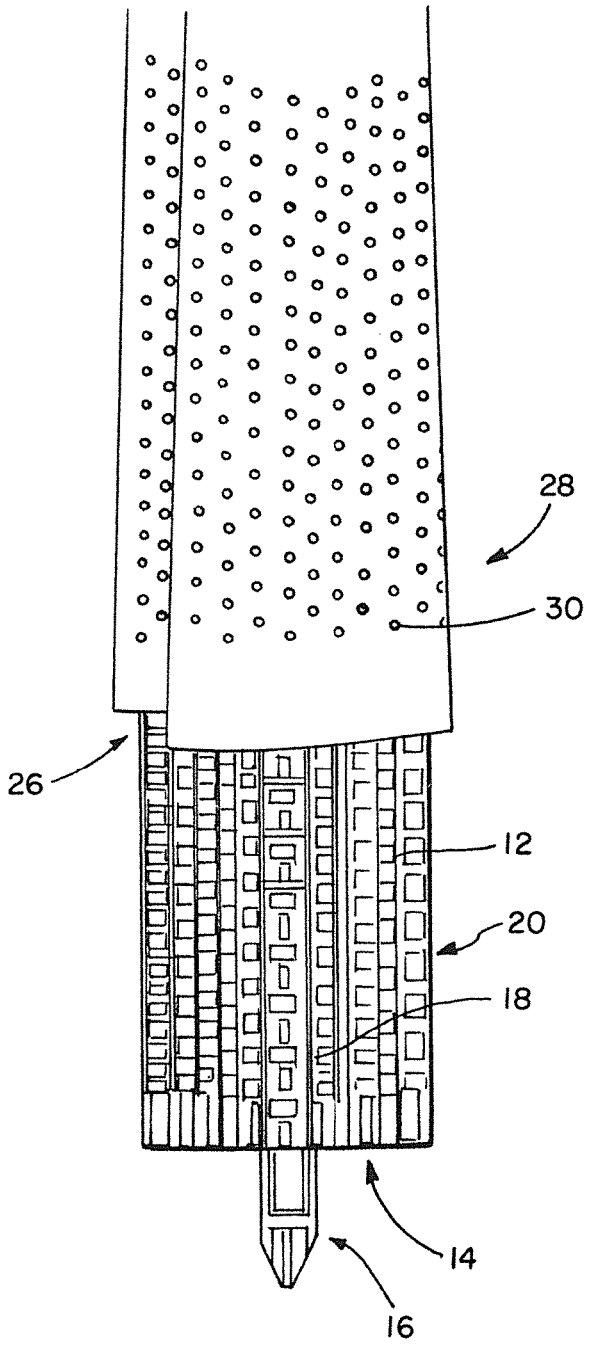
FIG. 2 is a detail picture of the lower end of a modern pelt board showing the foot of pelt board and a part of the holding area, of which a part is covered by the pelt board inner bag according to the invention.
Figure 3:
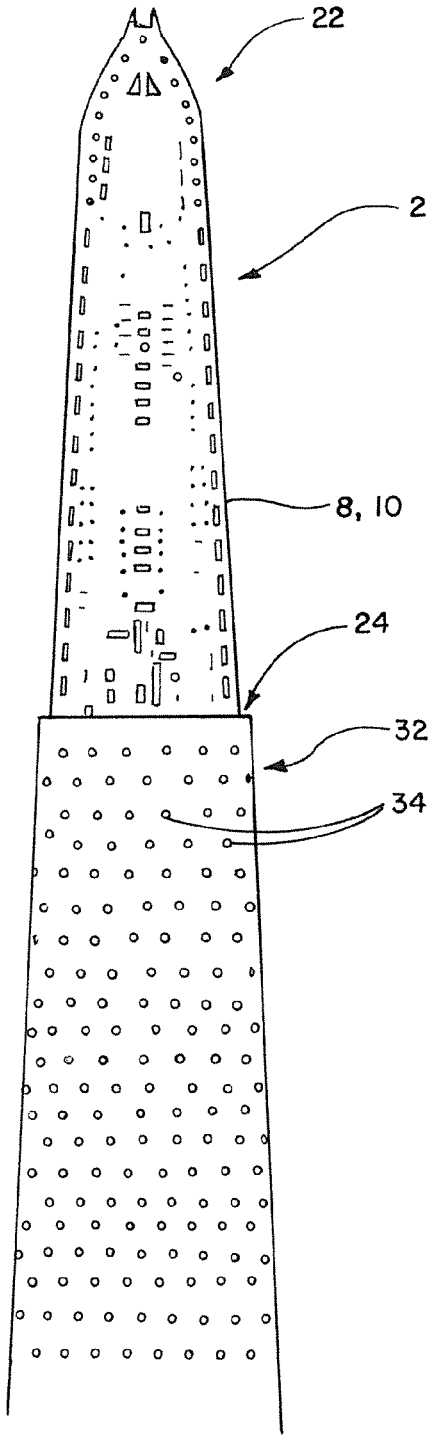
FIG. 3 is a detail view of the upper nose end of the modern pelt board shown in FIG. 1, partly covered with the pelt board inner bag according to the invention.

The tube shaped pelt board inner bag 6, which in the shown embodiment is made of moisture- and fat absorbing paper material, has a first end boundary 26 and a second end boundary 24. As it further appears from FIG. 1, but more clearly of FIG. 2, the pelt board inner bag 2 comprises closest to the first end boundary 26 a number of rows og through going holes 30, and further comprises the pelt board inner bag 2, nearest the second end boundary 24 further a number of rows 32 of through going holes 34, cf. FIG. 3.

Figure 4:
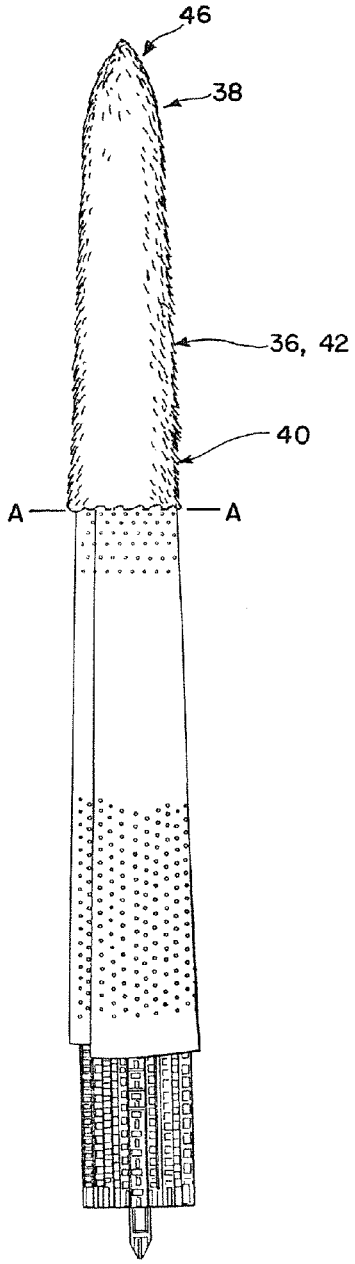
FIG. 4 is a picture of the modern pelt board shown in FIG. 1 with a pelt board inner bag according to the invention and with a pelt drawn on shown from the belly/jaw side, where the pelt has been made transparent from the velvet line A-A.
Figure 5:
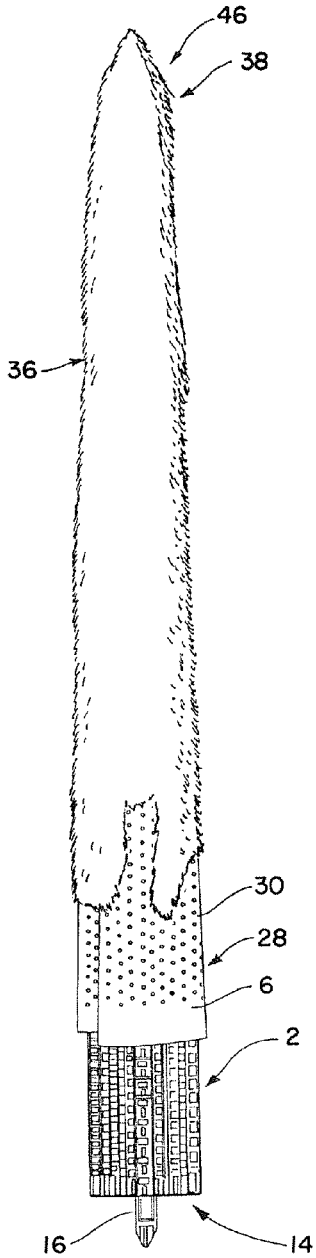
FIG. 5 is a picture of the modern pelt board shown in FIG. 1 with a tube shaped pelt board inner bag drawn on, and a mink pelt drawn onto the pelt board inner bag.

In FIG. 5 the pelt board 2 shown in FIG. 1 is disclosed with a pelt board inner bag 6 according to the invention with a mink pelt drawn 36 on, shown from the jaw side 38. As it further appears from FIG. 4 and FIG. 5, the front paws 40 of the pelt appears, where the pelt on some locations is triple laid. As it further is shown in FIG. 4 wherein a part of the pelt 36 is made transparent from the line A-A, the pelt board inner bag 2 according to the invention comprises rows of holes 32, with holes 34.

Figure 6:
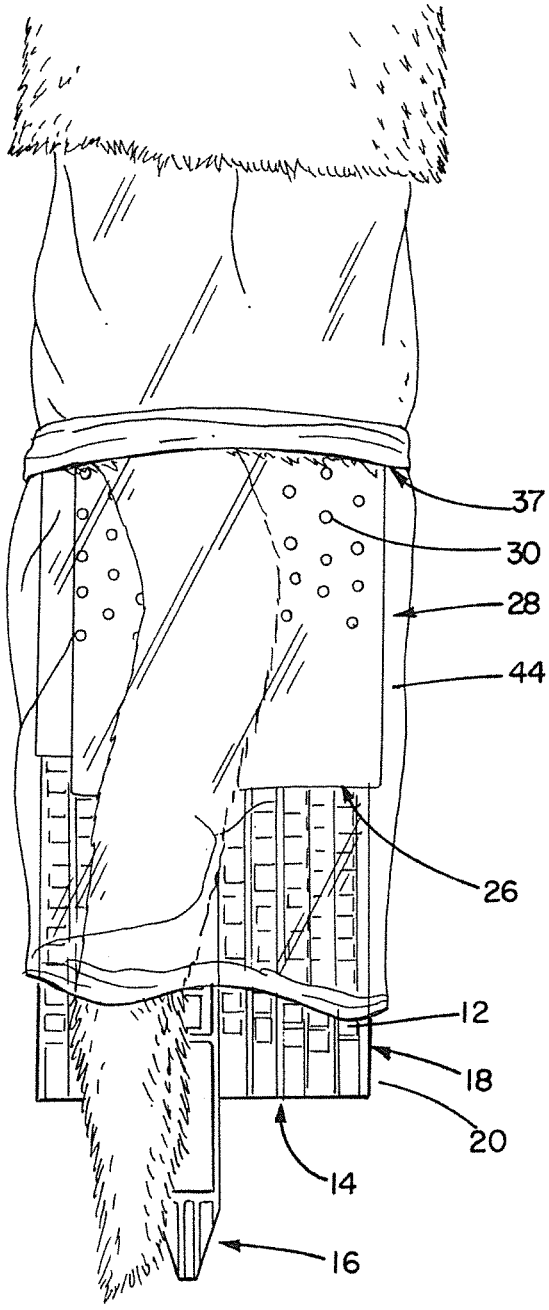
FIG. 6 is a detail picture of the holding area of the pelt board shown in FIG. 1, with a drawn on pelt board inner bag and onto that a mink pelt which is stretched out and retained in stretched position with a holding bag.

In FIG. 6 which is a detail view of the pelt board 2 near the foot end 14, the stretched pelt 36 outside the pelt board inner bag 2 according to the invention, and the pelt is retained in its stretched position in the holding area 4 of the pelt board by a holding bag 44 drawn onto the outside of the fur side 42 of the pelt, said holding bag pressing the lower end of the pelt 36, the tail end 37, and therewith the pelt board inner bag 6 against the surface of the corrugated holding area 4

The purpose of said rows 28 of holes 30 closest to the first end boundary 26 is to secure an improved retention of the pelt 36 stretched out on the pelt board 2 caused by the holding bag pressing the pelt and therewith the holes 30 of the pelt board inner bag against the corrugated surface of the pelt board, whereby there is achieved an improved friction between the pelt board inner bag 2 and the surface of the pelt board 10 in the holding area 4, which means that the pelt 36 does not slip on the pelt board 2 during the subsequent drying procedure, and thus maintaining the size it has been stretched out to, also after the removal of the pelt 36 from the pelt board 2. The holes serves further to an improved drying of the pelt 36 in the area effected by the by the holding bag 44 as a more direct exchange of air below the leather side (not shown) of the pelt during the drying procedure is achieved, where the air in the cavity (not shown) between the half shells 8, which further is bounded by the pelt board inner bag 6, the pelt 36 and partly of the holding bag 44 is typically exchanged by injection of conditioned drying air via holes in the bluntly protruding party 16 from the foot end 14 of the pelt board, said drying air passing through the cavity, and diffuses out through natural openings near the nose end 46 of the pelt, typically through the jaw opening 38.

The purpose of the hole rows 32 with the holes 34 nearest to the second end boundary 24 of the pelt board inner bag is the ensure an improved and more efficient drying of the pelt in the area at the front paws 40 where the pelt some places is triple layered and therefore difficult to dry out. Further the pelt board inner bag 2 of fat- and moisture absorbing paper or material with corresponding properties, serves to remove/reduction of residual fat on the leather side of the pelt which has not been removed by the prior scraping of the pelt. The holes 34 thus serves to the achievement of a more directly connection between the drying air and the leather side of the pelt in this area.

The effect of the pelt board inner bag 6 according to the invention is in general that residual fat will draw out into the fat- and moisture absorbing material, the paper. The moisture will evaporate and be carried away by the exchange of the air in the cavity inside the pelt board 2, below the holes 12 located below the pelt board inner bag 6. The bag 6 function like the old familiar blotting paper.

By the absorption of residual fat from the leather side of the pelt in the pelt board bag 6 according to the invention is as all ready stated achieved a better friction force between the holding area 4 and the stretched pelt 36, which is further improved by the hole rows 28, with the holes 28 which by the pressure force exerted by the holding bag 44 is pressed against the corrugations in the holding area, whereby the pelt 36 is better retained in its stretched out position during the drying procedure.

The bag 6 can further advantageously be made of perforated paper, which will help to increase the transport of moisture away from the paper.

The bag 6 has a conical shape in the shown embodiment, corresponding to the conical shape of the pelt board 2. The pelt board inner bag 6 which is shorter than the pelt board and is suited to be drawn onto the pelt board 2 from its pointed end 22, with the largest opening diameter at the first end boundary facing the foot end 14 of the pelt board. The pelt board inner bag is drawn down over the pelt board 2 until it is stuck on the outside surface where it covers a part of the holding area 4. The pelt board inner bag 6 may in a not shown embodiment be designed so that it only covers the holding area 4 on the pelt board 2 completely or partly (cf. FIG. 1)

Finally it should be stated that the pelt board inner bag 2 according to the invention further can be used together with other modern types of pelt boards, par example a pelt board of the type consisting of at flattish body with the same peripheral shape as the pelt board 2 shown in FIG. 1, but where the flattish body on both side surfaces comprises protruding ribs oriented in the length direction of the pelt board, the height of the ridges of which are decreasing towards the pointed end of the pelt board, and where the foot end of the pelt board like the pelt board 2 shown in FIG. 1 and others, comprises a blunt protruding party through which is performed blowing or exhaust of drying air which is blown into the cavities bounded between the ridges of the ribs and a pelt board inner bag drawn onto the pelt board with a onto these draw pelt, which is retained in the stretched position by a holding bag or a wrap of film, or wrap.

The invention claimed is:

1. An inner bag for cladding a pelt board having an outer surface defining a holding area between a nose end and a foot end of the pelt board, the inner bag comprising:

a sheet of fat- and moisture-absorbing material formed into a tubular configuration so as to conform to and engage with the holding area of the outer surface of the pelt board, the material being perforated with perforations of a first diameter, wherein the sheet, when formed into the tubular configuration, has a first end boundary and a second end boundary;

wherein the sheet has a plurality of holes adjacent at least one of the first end boundary and the second end boundary, wherein the holes in the plurality of holes have a second diameter greater than the first diameter.

2. The inner bag of claim 1, wherein the fat- and moisture-absorbing material is paper having fat- and moisture-absorbing properties.

3. The inner bag of claim 1, wherein the sheet, when formed into the tubular configuration, has an extent between the first end boundary and the second end boundary corresponding to at least ⅓ of the extent of the holding area of the outer surface of the pelt board.

4. The inner bag of claim 1, wherein the sheet has a first plurality of holes adjacent the first end boundary and a second plurality of holes adjacent the second end boundary, and wherein the holes in the first plurality of holes and the holes in the second plurality of holes have a second diameter that is greater than the first diameter.

5. The inner bag of claim 1, wherein the outer surface of the pelt board, at least in the holding area, includes a corrugated structure, and wherein the second diameter of the holes in the plurality of holes is sufficient to engage and adhere to the corrugated structure.

* * * * *